US006039397A

United States Patent [19]

Ginat

[11] Patent Number: 6,039,397

[45] Date of Patent: Mar. 21, 2000

[54] TILT BACK CHAIR CONTROL

[76] Inventor: Jonathan Ginat, 26 W. 9th St., New York, N.Y. 10011

[21] Appl. No.: 09/036,703

[22] Filed: Mar. 6, 1998

Related U.S. Application Data

[62] Division of application No. 08/481,718, Jun. 7, 1995, Pat. No. 5,725,276.

[51] Int. Cl.[7] ..... A47C 3/00

[52] U.S. Cl. ..... 297/289; 297/300.5; 297/301.4; 297/301.5; 297/303.4; 297/323

[58] Field of Search ..... 297/302.4, 286, 297/289, 300.2, 300.5, 300.6, 303.1, 303.4, 316, 320, 374, 375, 323, 326, 301.4, 301.5

[56] References Cited

U.S. PATENT DOCUMENTS

| | | |
|---|---|---|
| 244,585 | 7/1881 | Ginter . |
| D. 318,588 | 7/1991 | Koepke . |
| 339,016 | 3/1886 | Sawyer . |
| 1,278,729 | 9/1918 | Odell . |
| 4,076,308 | 2/1978 | Slabon . |
| 4,156,544 | 5/1979 | Swenson . |
| 4,364,605 | 12/1982 | Meiller . |
| 4,429,917 | 2/1984 | Diffrient . |
| 4,509,793 | 4/1985 | Wiesmann . |
| 4,652,049 | 3/1987 | Maruyama . |
| 4,682,814 | 7/1987 | Hansen . |
| 4,682,815 | 7/1987 | Steifensand . |
| 4,685,733 | 8/1987 | Machate . |
| 4,693,514 | 9/1987 | Volkle . |
| 4,709,963 | 12/1987 | Uecker . |
| 4,840,426 | 6/1989 | Vogtherr . |
| 4,861,106 | 8/1989 | Sondergeld . |
| 4,889,385 | 12/1989 | Chadwick . |
| 4,981,326 | 1/1991 | Heidmann . |
| 4,986,601 | 1/1991 | Inoue . |
| 5,102,196 | 4/1992 | Kaneda . |
| 5,121,934 | 6/1992 | Decker . |
| 5,160,184 | 11/1992 | Faiks . |
| 5,249,839 | 10/1993 | Faiks et al. . |
| 5,308,145 | 5/1994 | Koepke . |
| 5,318,345 | 6/1994 | Olson . |
| 5,328,237 | 7/1994 | Yamaguchi . |
| 5,452,937 | 9/1995 | Piretti . |
| 5,460,427 | 10/1995 | Serber . |

*Primary Examiner*—Milton Nelson, Jr.
*Attorney, Agent, or Firm*—Natter & Natter

[57] ABSTRACT

A tilt back chair provides for selective independent and concurrent movement of a chair back with respect to a chair seat. The seat is mounted to a spring biased bracket for pivotal movement about a seat tilt axis. The back is connected to a pair of pivot brackets projecting upwardly from the seat to provide for pivotal movement about a back tilt axis located above the seat and rearwardly of the seat tilt axis. When the seat is in a neutral seating position it can tilt downwardly at its forward edge about the seat tilt axis. The back is biased for displacement with the forward tilt of the seat and is tiltable rearwardly independently of the seat. The seat can also be locked in a fixed position.

7 Claims, 9 Drawing Sheets

TILT BACK CHAIR CONTROL

This application is a Division of Ser. No. 08/481,718 filed Jun. 7, 1995 U.S. Pat. No. 5,725,276.

BACKGROUND OF THE INVENTION

1. Field of the Invention

The present invention relates generally to the construction of chairs suitable for use in an office environment and more particularly to a chair which offers improved comfort due to its particular control of back tilt and seat tilt functions.

2. Description of the Prior Art

Many attempts have been made to improve the comfort of chairs used in the vagaries of office environments. Chairs are well-known, for example, which have a tiltback feature wherein the back of the chair tilts rearwardly as the forward edge of the chair tilts up. In a simple form, such a chair may have its back and seat immovably connected relative to one another and supported by a control assembly which is pivotable with respect to the chair base and which includes one or more springs for biasing the seat and back to a normally neutral position. However, in such chairs, as the user leans back, the forward portion of the seat exerts upward pressure on the upper legs of the user and can impair blood circulation in the user's legs. Such a result can be uncomfortable to the user. Also, excessive seat tilt can tend to raise the user's feet from the floor thereby causing the user to lose stability while leaning back in the chair.

In order to alleviate the problems associated with excessive seat tilt, chair controls have been developed, known as synchronous controls, which provide for different rates of tilt of the back and seat. With such a control, there is typically a greater degree of back tilt to seat tilt. The user can thereby lean well back in the chair without experiencing excessive pressure on his or her legs and without raising the feet from a firm position on the floor. An example of such a control is disclosed in U.S. Pat. No. 5,318,345 issued to Olson and assigned to the common assignee herein.

While synchronous controls of the foregoing type improve over the prior art in terms of chair comfort, they are typically complex in construction and represent a substantial cost in the manufacture of a chair. Another characteristic of these chairs is that in order to effect synchronous movement of the seat and back, the back typically has its pivot axis located beneath the seat. This arrangement causes the back of the chair to have an excessive downward component of movement as the user leans back in the chair. Thus, the chair back does not pivot in a manner which corresponds to the normal movement of the user's body. Moreover, a common disadvantage of such chairs is that the differential pivotal movement of the back relative to the seat creates an undesirable frictional effect on the user. Such an effect can manifest itself as an annoying phenomenon known as "shirt pull" wherein the shirt of the user becomes dislodged from the skirt or trousers. A further disadvantage of prior art chairs is that they lack a comfortable forward tilt feature which is often desirable for task intensive office environments.

Accordingly, it is desirable to provide a chair construction which is economical to manufacture and which also offers improved comfort over prior art constructions. It is further desirable to provide such a chair having a seat and back which are not restricted to a predetermined conjoint movement whereby the seat and back can adjust to a variety of user body positions. Still further, it is desirable to provide such a chair wherein the back pivots about an axis which more normally corresponds to the movement of the user's body. It is further desirable to provide such a chair with a comfortable forward tilt feature such that the chair is readily adaptable to being used in task intensive environments.

SUMMARY OF THE INVENTION

The present invention improves over the prior art by providing a chair having a seat and back in which the seat is pivotably connected to a base pedestal by a spring biased bracket assembly. A pair of upwardly extending brackets are fixed to opposite sides of an upper surface of the seat, and in one form of the invention a generally U-shaped frame member extending beneath the seat is pivotably connected to the two brackets. Connected to the frame member is a seat back support member which carries the back of the chair. The support member is biased by a pair of coil springs disposed adjacent the seat bracket assembly such that the back assumes a normally forward position relative to the seat.

A seat stop arrangement is provided between the seat and back such that as the user leans back in the chair the seat remains in a neutral position while the back is free to tilt rearwardly. The stop arrangement also permits the seat to tilt forwardly with the back following the seat in a forward tilt manner. The chair may thereby be used comfortably in task intensive work environments in which the user prefers to lean slightly forward in the chair. Because the pivot axis of the back is elevated relative to the seat, as opposed to being under the seat, the back moves in a manner which more closely corresponds to the normal rotation of the user's spine relative to the hip. Thus, a more comfortable and natural movement of the chair back is accomplished.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
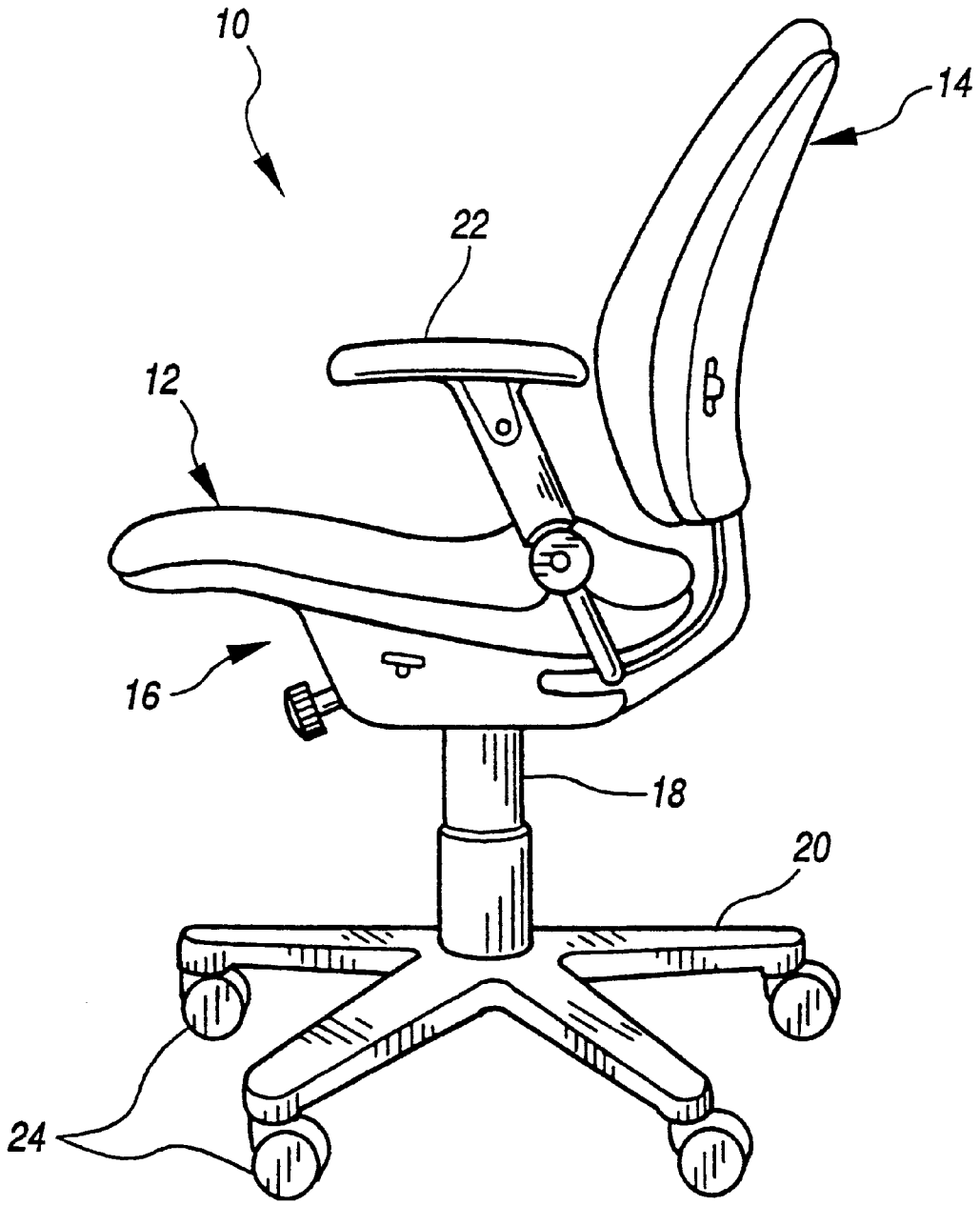
FIG. 1 is a side view of a chair constructed in accordance with the principles of the invention.

Referring now to the drawings, and initially to FIG. 1, a chair constructed in accordance with the invention is designated generally by the reference numeral 10 and includes a seat assembly 12 and a back assembly 14. The seat assembly 12 and back assembly 14 are supported by a control assembly 16, which will be described in detail hereinafter. The control assembly 16 is, in turn, connected to a suitable pedestal 18 extending upwardly from a conventional star base 20. It can be appreciated that the chair 10 is of a type suitable for use in an office environment, for example. To this end, the chair 10 may include arms 22 and the chair base 20 may include suitable casters 24.

Figure 2:
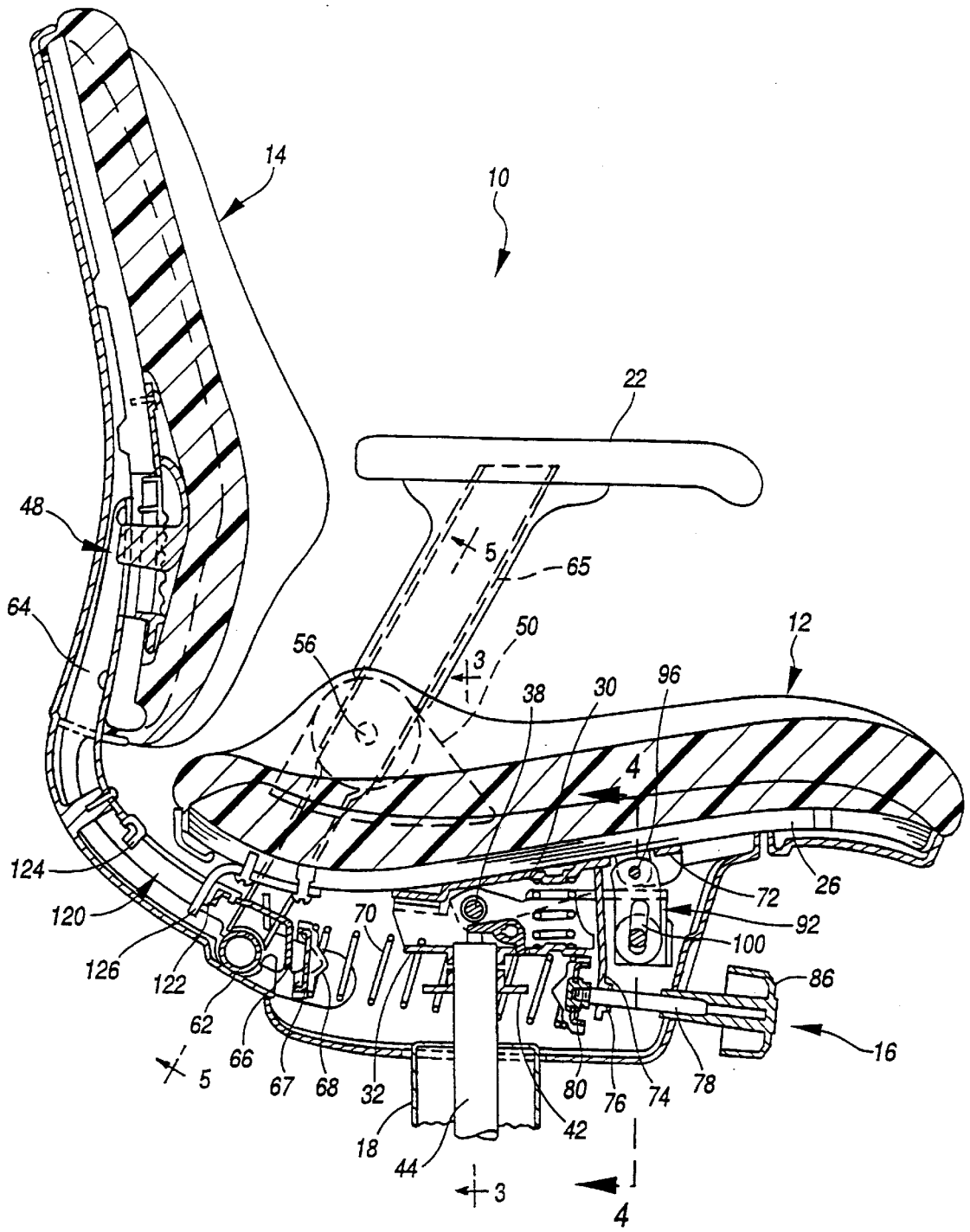
FIG. 2 is a partial side cross-sectional view of the chair of FIG. 1.
Figure 3:
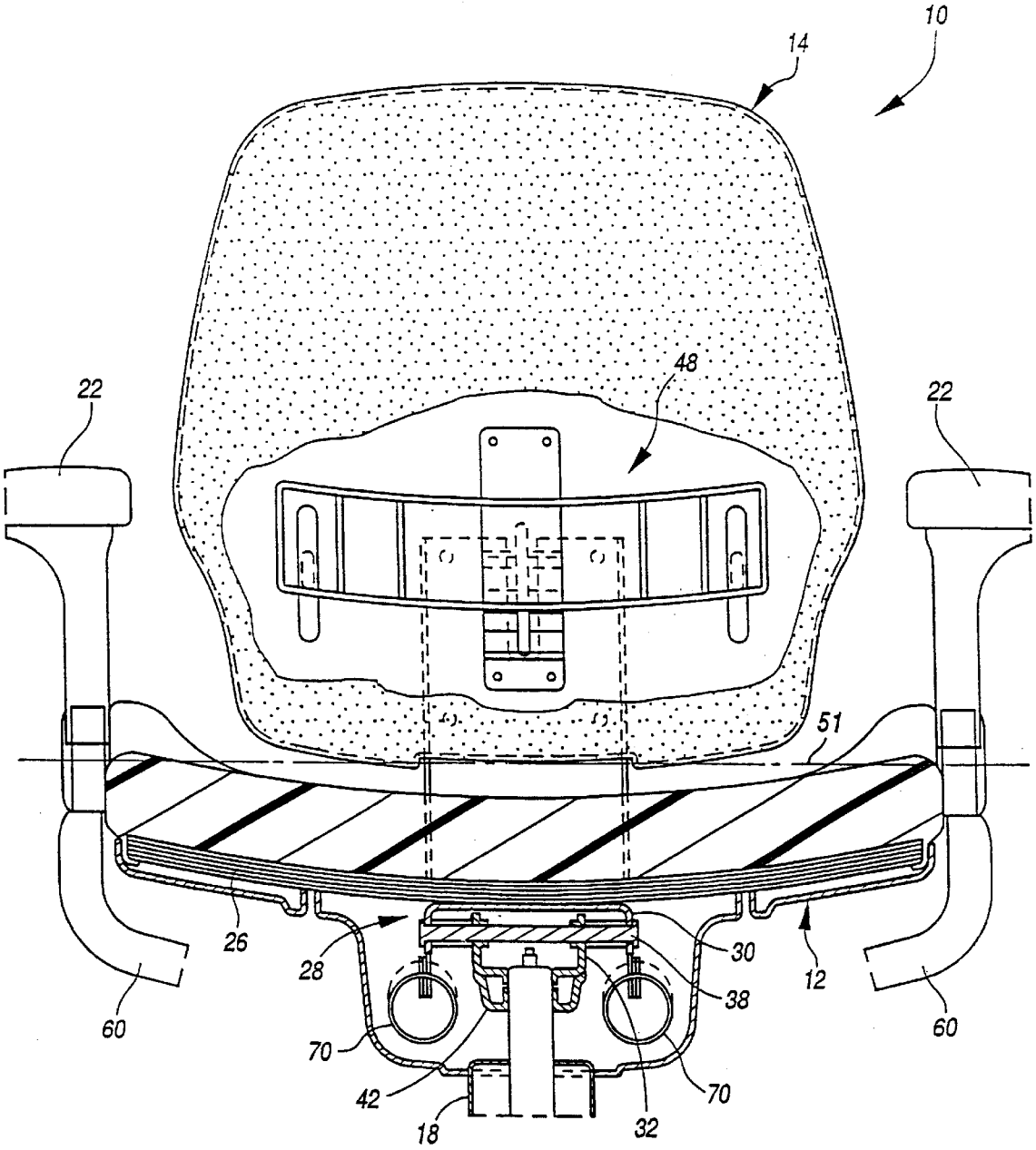
FIG. 3 is an auxiliary sectional view of the chair taken substantially along line 3—3 of FIG. 2.
Figure 6:
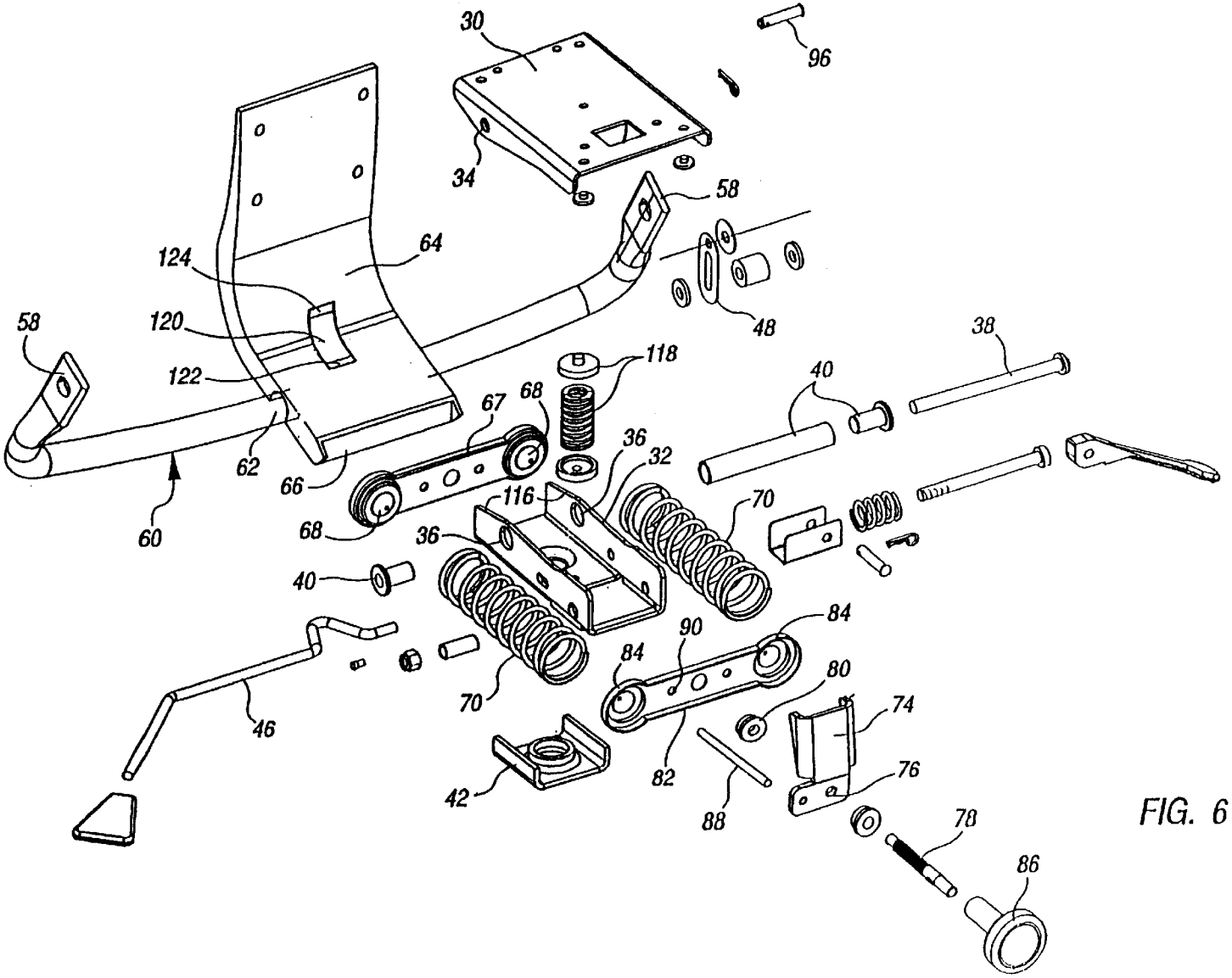
FIG. 6 is an exploded perspective view of the chair control components.

Referring now to FIGS. 2, 3 and 6, the chair 10 can be seen to include a seat pan 26 fastened at its underside to a bracket assembly 28 which comprises a generally U-shaped upper bracket 30 and a generally U-shaped lower bracket 32. The brackets 30, 32 have suitable apertures 34 and 36 for receiving a transverse pivot pin 38 and bushings 40. Thus, the lower bracket 32 is connected to the upper bracket 30 in pivotable relation with the pivot pin 38 defining a transverse seat tilt axis. Connected to the lower bracket 32 as by welding is a collar 42. The collar 42 cooperates with the lower bracket 32 to support the bracket assembly 28 on a suitable gas cylinder 44. In a manner well-known in the art, the gas cylinder 44 is supported within the base pedestal 18 and provides for height adjustment of the chair 10 by manual operation of a lever 46. With the upper bracket 30 secured to the underside of the seat pan 26 the chair seat assembly 12 is thereby pivotable relative to the base 20. Also in a manner well-known in the art, the back assembly 14 of the chair 10 may include a suitable adjustable lumbar support mechanism designated generally by the reference numeral 48.

Figure 5:
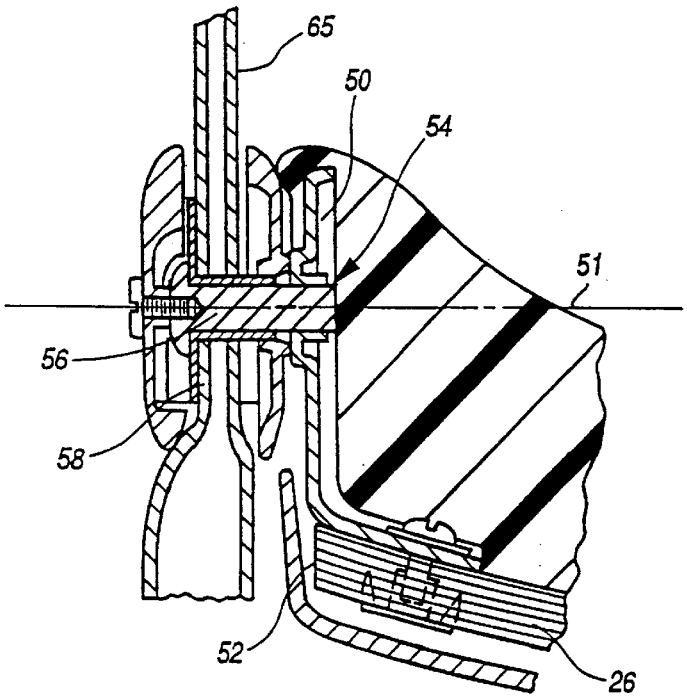
FIG. 5 is an auxiliary-sectional view of the arm and back pivot assembly of the chair taken substantially along line 5—5 of FIG. 2.

In accordance with the invention, and as best seen in FIGS. 2 and 5, the seat assembly 12 includes a pair of brackets 50 projecting upwardly from the seat pan 26 and secured to the seat pan 26 along opposite side edges 52 thereof. The brackets 50 are each provided with a threaded aperture 54 for receiving a pivot pin 56. Pivotably connected to the brackets 50 are distal end portions 58 of a generally U-shape tube member 60 having a portion 62 intermediate the ends 58 which extends across and underneath the rear of the seat pan 26. The tube member 60 is connected as by welding at its intermediate portion 62 to a curved back support member 64. The back support member 64 is, in turn, connected to the back assembly 14 by suitable fastening means. By the foregoing arrangement, the back assembly 14 is pivotable about an axis lying at the centerline of the pivot pins 56. The end portions 58 of the tube member 60 may extend upwardly from the pivot pins 56 to define suitable stems 65 (FIGS. 2 and 5) to which the arms 22 are attached. The arms 22 are thereby pivotable with the back assembly 14. The end portions 58 of the tube member 60 may also terminate at the pins 56 (FIG. 5) to provide an armless version of the chair 10.

In order to bias the back assembly 14 in a normally forward position, as best seen in FIGS. 2 and 6, forward end 66 of the back support member 64 is provided with a generally elongate spring support plate 67 having two opposed end projections 68 for supporting compression springs 70. The springs 70 are preferably disposed along opposite sides of the lower bracket 32 and beneath the upper bracket 30. Extending downwardly from forward end 72 of the upper bracket 30 is a plate 74. The plate 74 has a threaded aperture 76 for receiving a threaded rod 78. The rod 78 is connected at one end through a bearing 80 to a forward spring support plate 82. The plate 82, like plate 67, is provided with opposed projections 84 for supporting forward ends of the springs 70. By the foregoing arrangement, the rod 78 may be manually turned by an associated knob 86 to move the spring support plate 82 forwardly or rearwardly of the chair 10 and thereby provide for adjustable tensioning of the back assembly 14. To stabilize the support plate 82, a guide rod 88 extends through an aperture 90 of the plate 82 and is secured to plate 74. (See FIG. 6.)

Figure 4:
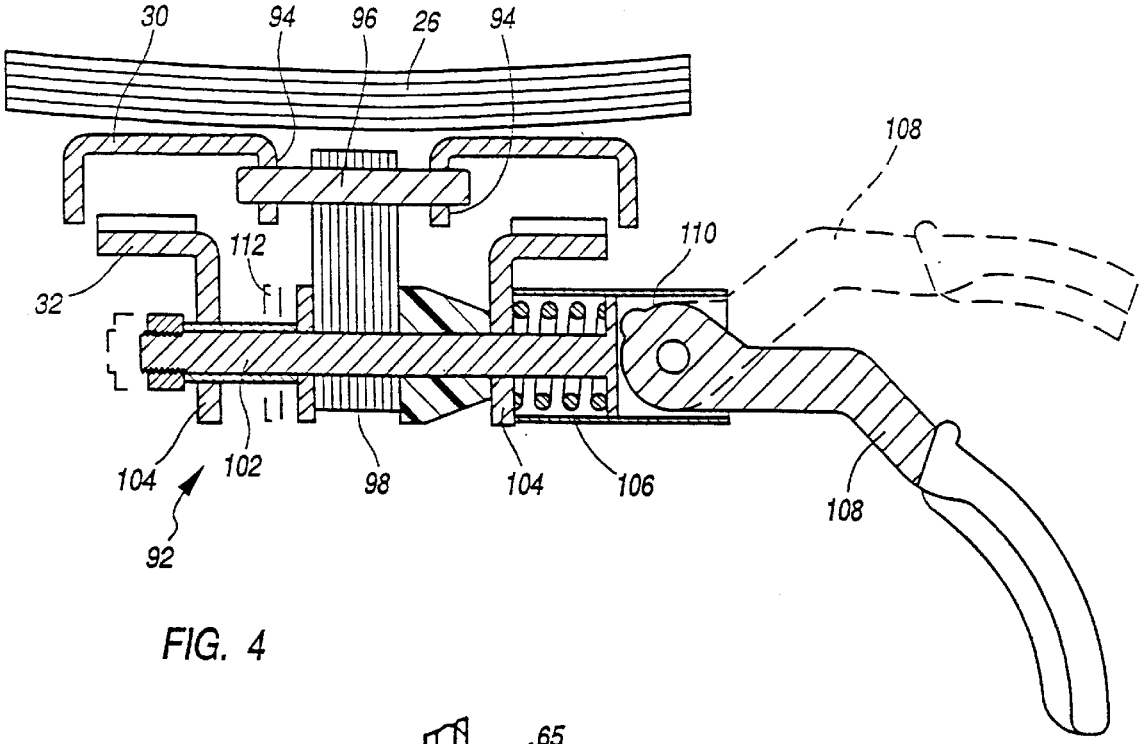
FIG. 4 is an auxiliary-sectional view of the tilt locking mechanism of the chair taken substantially along the line 4—4 of FIG. 2.

Turning now to FIGS. 2 and 4, the control assembly 16 of the chair 10 includes a clutch assembly designated generally by the reference numeral 92. The clutch assembly 92 which is disposed forwardly of the pivot pin 38 and plate 74 is designed to lock the upper and lower brackets 30 and 32 in a preferred relative angular disposition and, thereby, lock the seat assembly 12 in a desired angle of forward tilt. To this end, the upper bracket 30 is provided at its forward end 72 with a pair of downwardly extending ears 94 having apertures for supporting a transversely extending pin 96. The pin 96 carries a series of lamells 98 which define a longitudinal slot 100 through which an actuating rod 102 extends. The rod 102 in turn is supported by ears 104 extending from the lower bracket 32 and is biased by a spring 106. A suitable pivoting lever 108 having a cam surface 110 provided on an end thereof moves the rod 102 transversely causing selective engagement and disengagement of a bearing 112 and collar 114 with opposed sides of the lamells 98. The rod 102 may thereby be locked to the lamells 98 in any desired position within the slot 100 and thus the relative angular disposition of the brackets 30 and 32 may be adjusted and immovably established if desired.

OPERATION

It can now be appreciated that the chair 10 of the present invention offers considerable advantages in comfort over prior art chairs particularly in task intensive office environments. As best seen in FIG. 6, the lower bracket 32 is provided with stop surfaces 116 which engage the upper bracket 30 and limit relative pivoting movement of the brackets 30 and 32. Further, a compression spring assembly 118 is disposed between the upper and lower brackets 30 and 32 forwardly of the pivot pin 38 to normally bias the brackets 30, 32 to the maximum relative angular disposition. Thus, the seat assembly 12 is normally biased to a neutral position, but it can tilt downwardly at its forward edge under the weight of the user as the user moves more forwardly in the chair 10. Preferably, as shown in FIG. 2, the pivot pin 38 is aligned approximately along the vertical centerline of the gas cylinder 44. Accordingly, the normal center of gravity of the user is approximately positioned over the center of the base 20 thus providing for stability.

An important feature of the invention as best seen in FIG. 2 is the provision of a slot 120 formed in the back support member 64 having associated stop surfaces 122 and 124. Further, a stop arm 126 is fixed to the rear undersurface of the seat pan 26 in such a position as to cooperate with the stop surfaces 122 and 124 of the slot 120 and cause selective interrelated movement of the seat and back assemblies 12 and 14, respectively. For example, when the seat assembly 12 is in the neutral upwardly biased disposition (See FIG. 2), the back assembly 14 is normally biased by springs 70 to a forward disposition limited by engagement of the stop arm 126 with the stop surface 122. However, with the seat assembly 12 maintained in the aforesaid neutral position, the chair user can lean backwards causing the back assembly 14 to tilt back within a range of tilt until the stop arm 126 comes into engagement with stop surface 124. Further, if the user desires to lean forward in the chair 10, such as in task intensive situations, the seat assembly 12 can tilt downwardly at its forward edge causing the stop arm 126 to rotate upwardly, or clockwise as viewed in FIG. 2 which, in turn, allows the back assembly 14 to tilt forwardly with the seat assembly 12 under the biasing force of the springs 70. This conjoint movement of the seat and back assemblies, 12 and 14, provides comfortable back support while the user is leaning forward. However, the back assembly 14 is still free to tilt back while the user is positioned forwardly in the chair 10, thereby comfortably accommodating a variety of user positions. An important feature of the chair 10 is that the user may lock the seat assembly 12 in a forward tilt position using the clutch assembly 92. With the back assembly 14 then free to tilt back, the user can adjust his or her position in the chair 10 and thereby avoid muscle fatigue as would result from prolonged seating in a single fixed position while performing task-type work.

Figure 7:
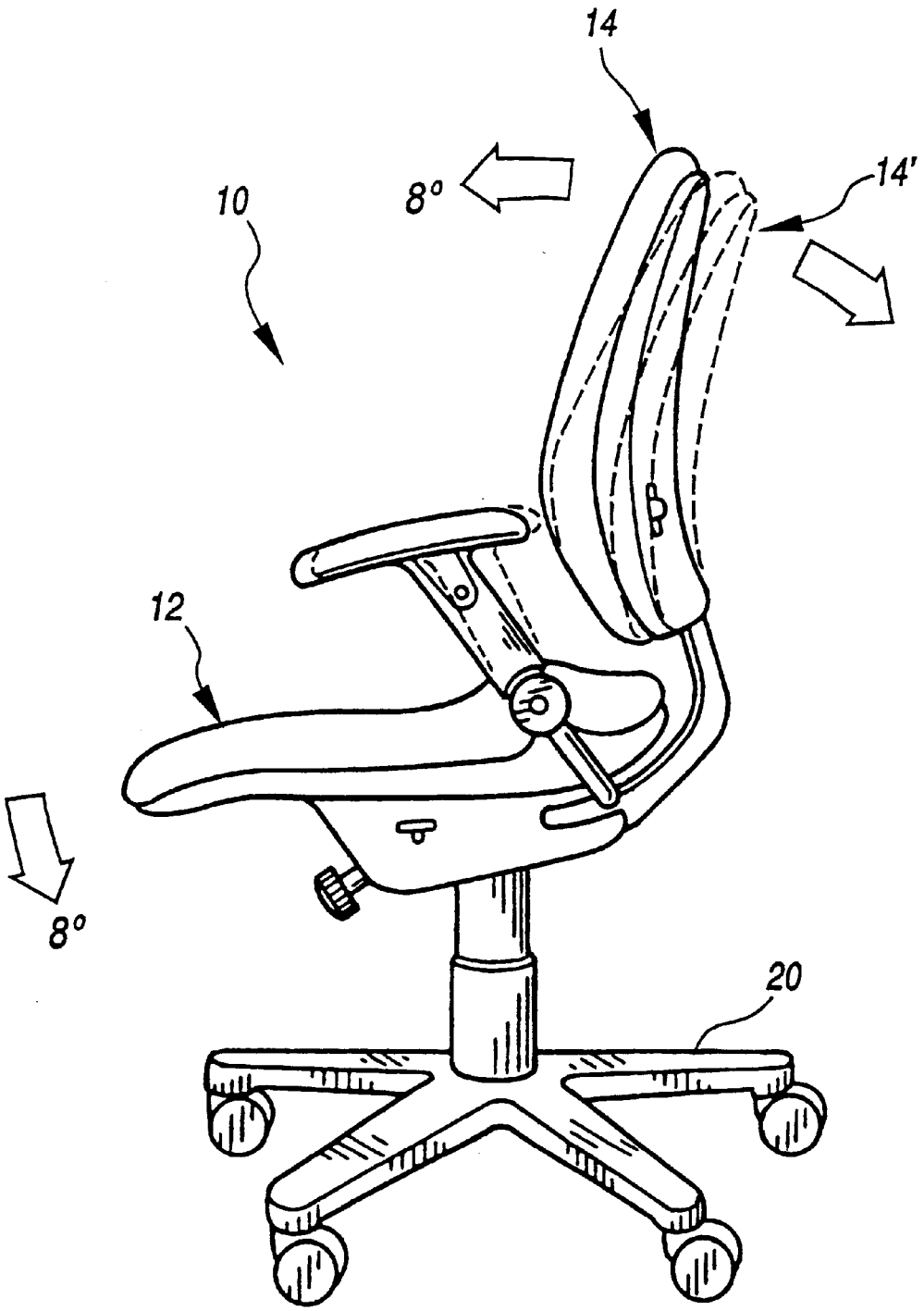
FIG. 7 is a side view of the chair illustrating its forward tilt feature.

FIG. 7 illustrates the relative movements of the seat and back assemblies 12 and 14 as the user sits forwardly in the chair 10 causing the seat assembly 12 to tilt downwardly at its forward edge. Preferably, the dimensions and configurations of the bracket assembly 28 are such as to allow the seat assembly 12 to pivot from its neutral position through an arc of approximately eight degrees before the bracket members 30 and 32 bottom on one another. This range of tilting movement has been found desirable for comfortably accommodating task work in an office environment, for example. User comfort is further enhanced by the normal conjoint eight degree forward tilt of the back assembly 14 as the back assembly 14 follows the tilt of the seat assembly 12. However, FIG. 7 also illustrates that while the seat assembly 12 is in the maximum angle of tilt, or in any intermediate angle of tilt, the back assembly 14' is free to tilt back relative to the seat assembly 12. Thus, the seat assembly 12 offers a characteristic "floating" effect to the user as the user adjusts position in the chair 10. Simultaneously, the back assembly 14' can also comfortably adjust to various positions of the user.

Figure 8:
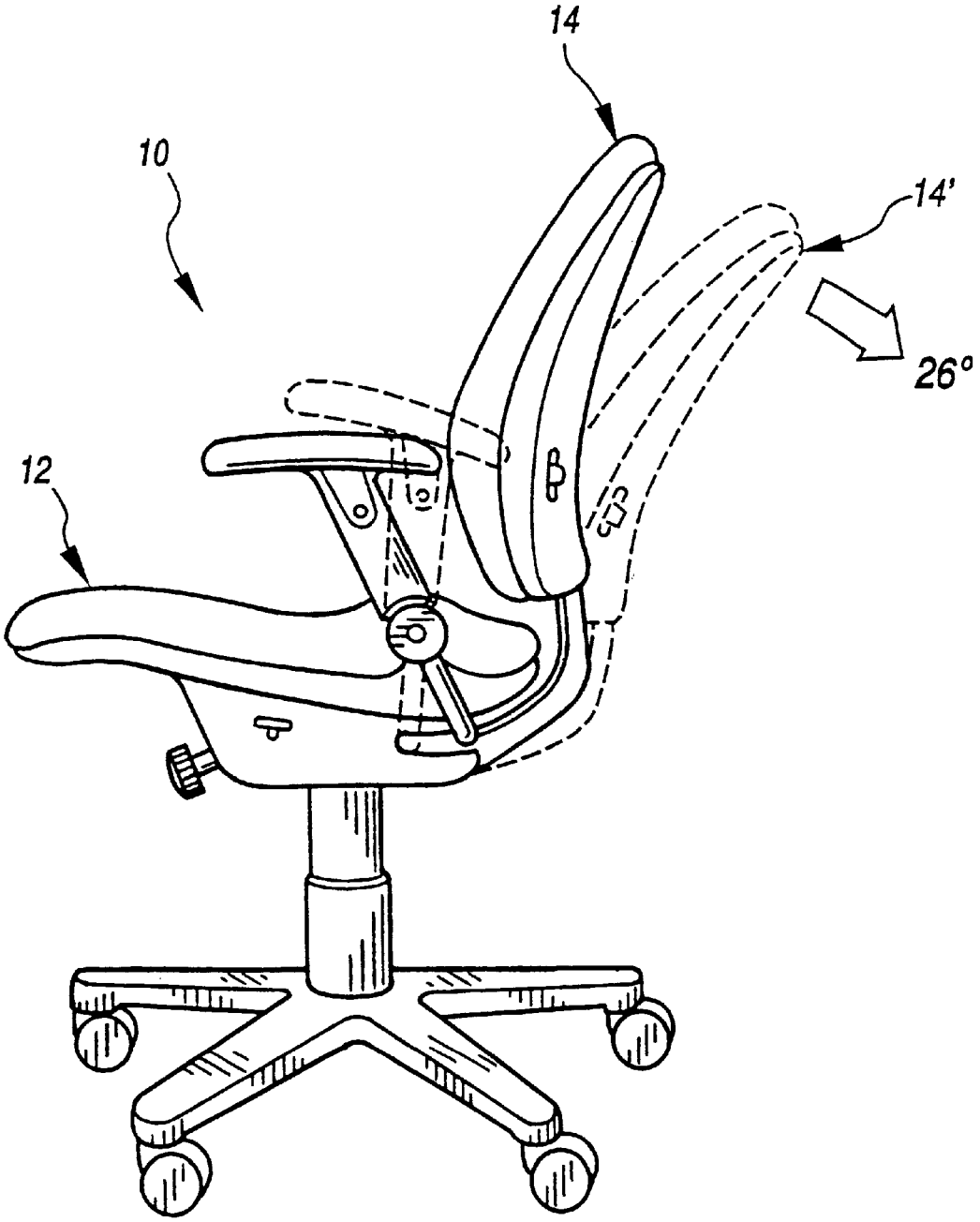
FIG. 8 is a side view of the chair illustrating its back tilt feature.

In FIG. 8 the chair 10 is shown with the seat assembly 12 biased to its neutral position, and having the back assembly 14 in its neutral forward tilt position. With the length dimension of the slot 120 suitably determined, the back assembly 14' preferably has a range of rear tilt from neutral of approximately twenty-six degrees. This range allows the chair user to lean back in the chair 10 to a preferred comfortable position without losing stability while seated. It is also important to note that in a version of the chair 10 having arms 22, the arms 22 will rotate upwardly as the back assembly 14 tilts back.

Figure 9:
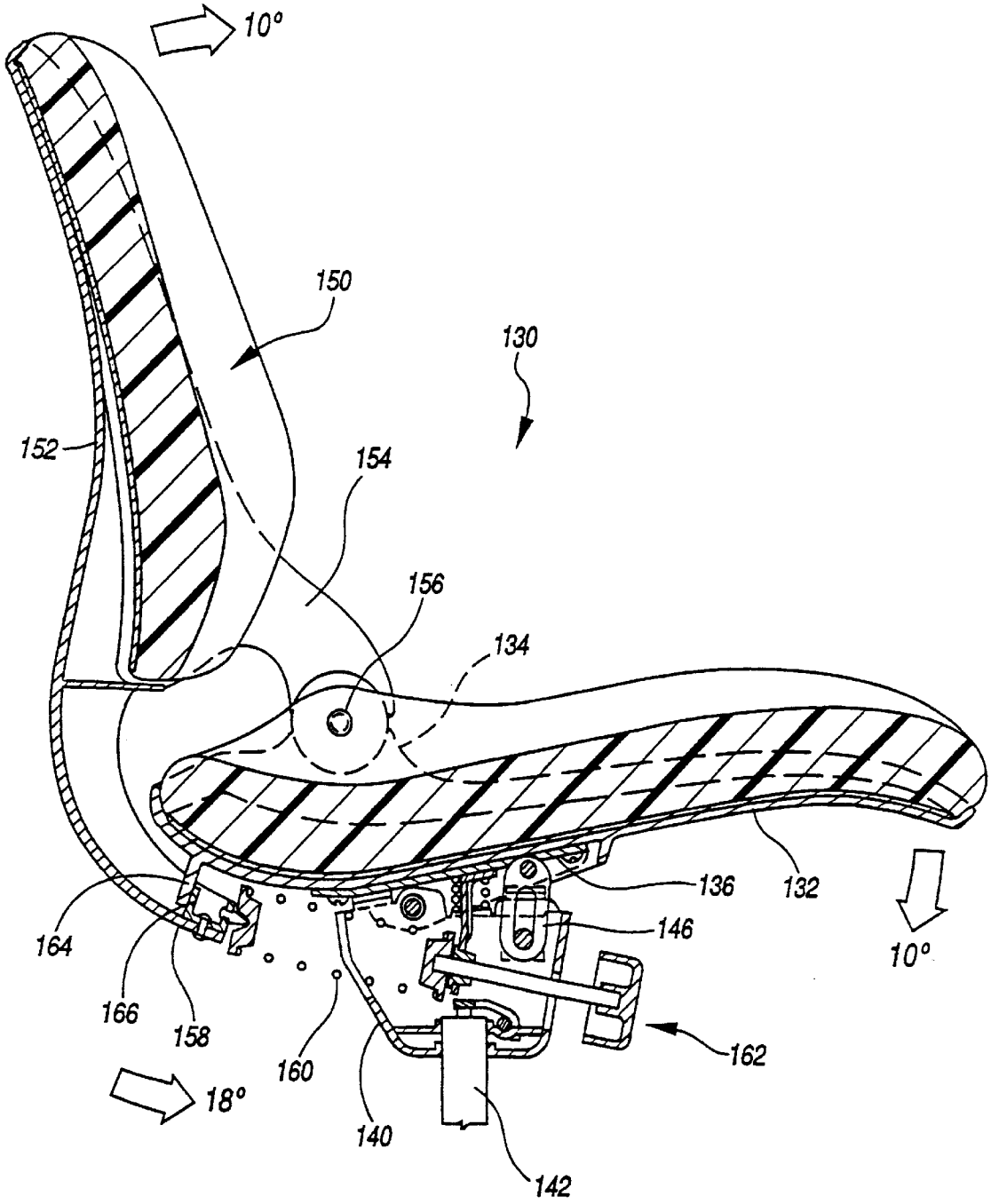
FIG. 9 is a side cross-sectional view of a second embodiment of a chair constructed in accordance with the principles of the invention.
Figure 10:
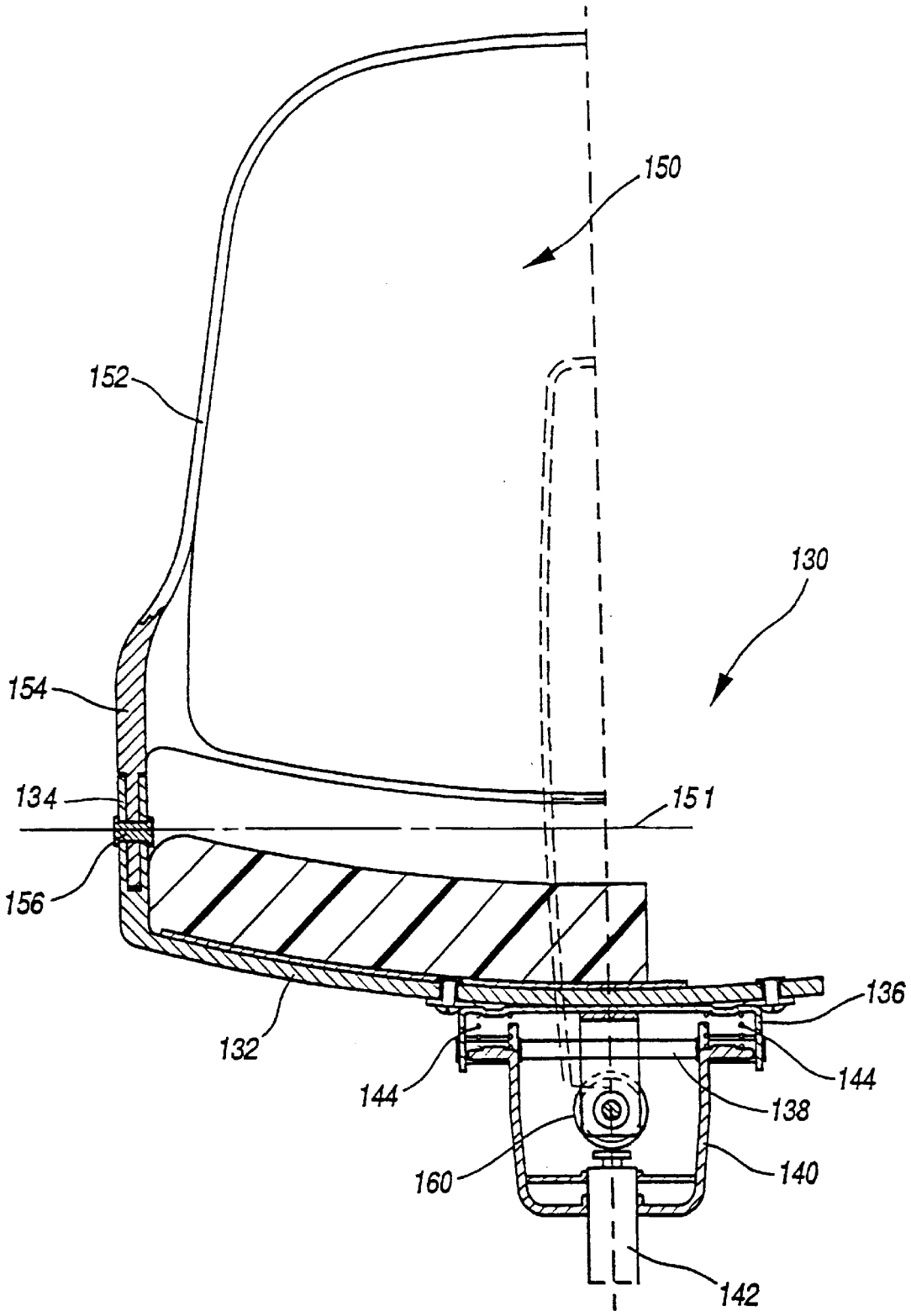
FIG. 10 is a partial front view of the chair shown in FIG. 9.

FIGS. 9 and 10 illustrate an alternative chair 130 constructed in accordance with the principles of the invention having a seat pan 132 molded from suitable plastic and having integrally formed upwardly extending back support brackets 134. A bracket member 136 is fastened to the underside of the seat pan 132 and is pivotably connected by a transverse pin 138 to a control housing 140. The control housing is, in turn, connected to a gas cylinder 142. Springs 144 are positioned between the bracket member 136 and control housing 140 to normally bias the seat pan 132 to an upward pivoted neutral position. A suitable clutch assembly 146 may be provided forwardly of the pivot pin 138.

In accordance with the invention, the chair 130 has a back assembly 150 including a back shell 152 molded from suitable plastic with a pair of forwardly extending arms 154 each projecting from a side of the shell 150 and configured to connect to the back support brackets 134 by pivot pins 156. The back shell 152 curves downwardly under the rear of the seat pan 132 terminating at a forward end 158. Connected to the end 158 is at least one compression spring 160 attached at a forward end to a suitable tension adjustment mechanism 162. Also integrally formed with the seat pan 132 is a stop arm 164 which cooperates with a stop surface 166 provided on the forward end 158 of the back shell 152. The back shell 152 is thereby normally biased by the spring 160 to a neutral upright pivoted position, but is free to tilt back regardless of the tilt position of the seat pan 132.

It can be appreciated that an important feature of the invention, as best seen in FIGS. 2 and 9, is that the brackets 50 and 134 define a pivot axis 51 and 151 respectively for the back assembly 14 and 150 which is located well above the seat pan 26 and 132, respectively, and preferably rearwardly of the bracket assembly pivot pin 38 and 138. In such a disposition, the axis of pivoting movement of the back assembly 14 and 150 closely corresponds to the axis of rotation of the user's spine at the hip. Thus, a more natural and comfortable movement of the user's body is possible over prior art constructions. It can also be appreciated that the present chair 10 and 130 improves substantially over prior art chairs in eliminating the undesirable "shirt pull" phenomenon.

It can be further appreciated that the chair 10 and 130 can be economically manufactured because of its relatively few simple parts and yet offers a wide range of seat and back dispositions to comfortably adjust to the user's seating position preferences. This is due, in part, to the fact that the seat pan 26 and 132 essentially functions as an integral part of the control assembly.

While the present invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A chair comprising:

a seat member;

a bracket assembly mounted to said seat member and having means for connection of said seat member to a base pedestal, said bracket assembly further including pivot means for pivotable movement of said seat member relative to said base pedestal;

a pair of back support brackets each connected to said seat member along opposite edges thereof and extending upwardly from said seat member;

a back member; and means for pivotably connecting said back member to said back support brackets, said means including a pair of arms each extending forwardly of said chair from a side of said back member wherein said back member is pivotable about an axis lying above the seat member.

2. The chair of claim 1 wherein said back support brackets are formed integrally with said seat member.

3. The chair of claim 1 wherein said arms are formed integrally with said back member.

4. The chair of claim 1 wherein said back member curves forwardly at a lower end and terminates at an end disposed beneath said seat member.

5. The chair of claim 4 wherein said end of said back member connects to a compression spring such that said back member is normally biased to an upright position.

6. A chair comprising a seat member and a back member, a bracket member mounted to the seat member, a base pedestal, said bracket member including a pin connection to said base pedestal defining a transverse seat tilt axis, a back support bracket mounted on said seat member and displaced forwardly with respect to the back member, said back support bracket defining a transverse back tilt axis lying above the seat member, said back member including forwardly extending arm members for supporting said back member with said back member being tiltable about the transverse back tilt axis, said seat member and said back member each being adapted for selective independent and concurrent movement.

7. A chair as claimed in claim 6 wherein the transverse back tilt axis is displaced rearwardly with respect to the transverse seat tilt axis.

* * * * *